US009523314B2

(12) United States Patent
Grob et al.

(10) Patent No.: US 9,523,314 B2
(45) Date of Patent: Dec. 20, 2016

(54) METHOD FOR OPERATING A COMBUSTION ENGINE IN ORDER TO PREVENT EXCESSIVE SWITCHING BETWEEN AT LEAST TWO MODES OF OPERATION

(71) Applicant: Audi AG, Ingolstadt (DE)

(72) Inventors: Andre Grob, Spiegelberg/Nassach (DE); Sebastian Ernst, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 14/369,098

(22) PCT Filed: Dec. 5, 2012

(86) PCT No.: PCT/EP2012/005002

§ 371 (c)(1),
(2) Date: Jun. 26, 2014

(87) PCT Pub. No.: WO2013/097921

PCT Pub. Date: Jul. 4, 2013

(65) Prior Publication Data

US 2014/0373810 A1 Dec. 25, 2014

(30) Foreign Application Priority Data

Dec. 27, 2011 (DE) ..... 10 2011 122 528

(51) Int. Cl.
*F02D 17/02* (2006.01)
*F02D 41/00* (2006.01)
(Continued)

(52) U.S. Cl.
CPC ..... *F02D 17/02* (2013.01); *F02D 41/0087* (2013.01); *F02D 41/021* (2013.01);
(Continued)

(58) Field of Classification Search
CPC ..... F02D 2200/501; F02D 2200/502; F02D 2200/703; F02D 2200/602; F02D 2200/702; F02D 2250/22; F02D 17/02; F02D 41/021; F02D 41/0087; F02D 2041/0012
(Continued)

(56) References Cited

U.S. PATENT DOCUMENTS 6,988,481 B2 * 1/2006 Sen et al. ..... 123/198 F
2003/0131820 A1 * 7/2003 Mckay et al. ..... 123/198 F
(Continued)

FOREIGN PATENT DOCUMENTS

DE 11 2009 006 567 9/2009
DE 11 2010 005 447 3/2013
(Continued)

OTHER PUBLICATIONS

International Search Report issued by the European Patent Office in International Application PCT/EP2012/005002 on Mar. 25, 2014.

*Primary Examiner* — Lindsay Low
*Assistant Examiner* — George Jin
(74) *Attorney, Agent, or Firm* — Henry M. Feiereisen LLC.

(57) ABSTRACT

A method for operating an internal combustion engine of a motor vehicle having a plurality of cylinders all of which are operated in a full load engine mode and some of which are shut down in a partial load engine mode is disclosed, wherein the full load engine mode is switched to the partial load engine mode only if a partial engine operating torque which can be provided by the internal combustion engine in the partial load engine mode is greater than or equal to a target torque set on the internal combustion engine. In order to switch from the full load engine mode to the partial load engine mode, a switch variable determined on the basis of at
(Continued)

least one specific parameter of the internal combustion engine and/or of the motor vehicle must additionally be set.

24 Claims, 2 Drawing Sheets

(51) Int. Cl.
*F02D 41/02* (2006.01)
*F02P 5/15* (2006.01)

(52) U.S. Cl.
CPC .. *F02D 2200/501* (2013.01); *F02D 2200/702* (2013.01); *F02D 2250/22* (2013.01); *F02P 5/1504* (2013.01)

(58) Field of Classification Search
USPC ..... 123/198 F, 198 DB, 481, 493, 492
See application file for complete search history.

(56) References Cited

U.S. PATENT DOCUMENTS

| | | | | |
|---|---|---|---|---|
| 2004/0055569 | A1* | 3/2004 | Matthews et al. | 123/399 |
| 2004/0231634 | A1* | 11/2004 | Sen et al. | 123/198 F |
| 2005/0000479 | A1* | 1/2005 | Niki et al. | 123/90.15 |
| 2005/0016492 | A1* | 1/2005 | Matthews | 123/198 F |
| 2007/0149358 | A1 | 6/2007 | Doering et al. | |
| 2009/0192692 | A1 | 7/2009 | Hartmann et al. | |
| 2009/0194064 | A1 | 8/2009 | Wong et al. | |
| 2011/0180037 | A1* | 7/2011 | Blom | 123/406.2 |
| 2012/0103312 | A1 | 5/2012 | Sasai et al. | |

FOREIGN PATENT DOCUMENTS

| | | |
|---|---|---|
| JP | 60-138235 | 7/1985 |
| WO | WO 2007/028683 | 3/2007 |

* cited by examiner

METHOD FOR OPERATING A COMBUSTION ENGINE IN ORDER TO PREVENT EXCESSIVE SWITCHING BETWEEN AT LEAST TWO MODES OF OPERATION

CROSS-REFERENCES TO RELATED APPLICATIONS

This application is the U.S. National Stage of International Application No. PCT/EP2012/005002, filed Dec. 5, 2012, which designated the United States and has been published as International Publication No. WO 2013/097921 A1 and which claims the priority of German Patent Application, Serial No. 10 2011 122 528.9, filed Dec. 27, 2011, pursuant to 35 U.S.C. 119(a)-(d).

BACKGROUND OF THE INVENTION

The invention relates to a method for operating a combustion engine of a motor vehicle with multiple cylinders all of which are operated in a full engine operation, and part of which are switched off in a partial engine operation, wherein switching from the full engine operation to the partial engine operation only occurs when a partial engine operation torque which the combustion engine is capable to be provide in the partial engine operation is greater or equal to a target torque set at the combustion engine. The invention also relates to a corresponding combustion engine.

Methods of the aforementioned type are known from the state-of-the-art. They are used for operating the combustion engine which is usually mounted in a motor vehicle and has multiple cylinders, i.e., at least two cylinders. However, the combustion engine can of course also be used outside of a motor vehicle. All of the cylinders of the combustion engine are operated in the full engine operation, which means that each of the cylinders performs a complete working cycle of suction, compression, combustion and exhaust. In particular in an operating state of the combustion engine in which only a small torque is to be generated by the combustion engine and thus a partial load operation is given, high pumping losses or gas exchange losses occur. In order to reduce the latter the cylinders can be switched off in particular in the partial load operation, i.e., the combustion engine is operated in the partial engine operation. In the partial engine operation at least one of the cylinders is switched off which in particular means that no fuel is introduced into the cylinder and no combustion occurs in the cylinder. Hereby advantageously all valves of the switched-off cylinder are kept closed in order to lower the gas exchange losses and thereby reduce fuel consumption. Turning off the cylinder allows significantly reducing the consumption disadvantage in the partial load operation of a combustion engine, in particular an Otto motor, which is quantitatively controlled by derating, compared to a combustion engine in particular a Diesel motor or Otto motor with stratified charge.

Switching to the partial engine operation is usually only permitted when the torque the combustion engine is capable of providing in the partial engine operation, in the following referred to as partial engine operation torque, is equal to the target torque which is to be provided by the combustion engine. When switching from the full engine operation to the partial engine operation and vice versa the provided torque, i.e., the actual torque, has to be kept constant as exact as possible in a combustion engine with cylinder switch-off in order to prevent bucking of the motor vehicle which would unacceptably affect comfort. Because the at least one turned-off cylinder does not contribute to the torque, the still operating cylinders have to compensate the latter and have to provide an actual torque which corresponds to the target torque.

This means that in the partial engine operation the load point is raised for the still operated cylinders. This raising of the load point requires for example approximately doubling the air charge of the still operated cylinders when switching from the full engine operation to the partial engine operation—in which half of the cylinders are turned off—i.e., in case of a half-engine operation, and requires approximately halving the air charge when switching from the partial engine operation to the full engine operation. However, the speed at which this change of air charge can be performed is limited. For this reason, in the switching time period in which switching from the full engine operation into the partial mode operation or vice versa occurs for example by means of correspondingly adjusting the ignition time point, the torque provided by the combustion engine has to be controlled. In this way a smoothening of the course of the outputted torque over time can be achieved so that the bucking can at least be partially prevented. However, changing the ignition time point reduces the combustion efficiency of the operated cylinders and with this the overall efficiency of the combustion engine. Each switching between the full engine operation to the partial engine operation or vice versa is associated with a lowering of the combustion efficiency or the overall efficiency in particular due to the temporary change of the ignition time point. Therefore fuel consumption is increased at each turning on or turning off of cylinders. The switching time range is for example about 500 ms per switching direction. Within this time range the fuel consumption may double. On average, switching time ranges of about 300 ms result, in which the fuel consumption increases by about 50%.

SUMMARY OF THE INVENTION

It is therefore an object of the invention to provide a method for operating a combustion engine of a motor vehicle, which compared to known methods for switching off cylinders has a significantly lower fuel consumption over the duration of operation of the combustion engine.

According to the invention this is achieved with a method for operating a combustion engine of a motor vehicle including providing a combustion engine having multiple cylinders and being operable in a full engine operation and in a partial engine operation, with all of the cylinders being operated in the full engine operation and at least one of the cylinders being deactivated in the partial engine operation; determining a switching variable as a function of at least one defined parameter of the combustion engine and/or the motor vehicle; determining from the at least one defined parameter an acceleration reserve; defining a minimal acceleration reserve; determining a recommended variable as a function of the acceleration reserve and the minimal acceleration reserve;

setting the switching variable when the recommended variable exceeds a threshold value; and switching from the full engine operation to the partial engine operation only when a partial engine operation torque producible by the combustion engine in the partial engine operation is greater than or equal to a target torque set on the combustion engine and the switching variable is set.

As explained above, during switching from the full engine operation to the partial engine operation and vice versa fuel consumption increases. However, when the switching from the full engine operation to the partial engine operation is complete, the cylinder deactivation can signicantly lower fuel consumption. When offsetting the increased fuel consumption during the switching from the full engine operation to the partial engine operation and vice versa with the fuel savings during the partial engine operation, an amortization time of for example about 3 s to 25 s results which usually depends on the load point. Switching from the full engine operation to the partial engine operation therefore only pays off when the partial engine operation is at least carried out over the entire amortization time. Correspondingly the only short-term partial engine operation has to be prevented.

For this purpose a waiting period can for example be defined, wherein switching from the full engine operation into the partial engine operation only occurs after expiration of the waiting period. The waiting period is set constant, i.e., it cannot be changed. According to the invention it is provided that for changing from the full engine operation to the partial engine operation at least two conditions have to be satisfied, namely that the partial engine operation torque is greater or equal to the set target torque and that the switching variable is set. The switching variable is hereby determined in dependence on the at least one parameter. The parameter can for example be assigned to the combustion engine, the motor vehicle and/or the environment. The switching variable is preferably only set when switching from the full engine operation to the partial engine operation actually allows decreasing the fuel consumption. In this way the frequency of the change from the full engine operation into the partial engine operation can be decreased. The switching variable is a binary Boolean variable, i.e., it can only assume two different values for example 0 and 1.

A refinement of the invention provides that the switching variable is determined during the operation of the combustion engine in defined time intervals. The switching variable is thus always updated, wherein a defined time interval is provided between two updating events. The switching variable is thus determined with a defined frequency, for example 10 Hz. Advantageously, the switching variable is determined at least during the full engine operation, however particularly preferably permanently, i.e., during the full engine operation as well as during the partial engine operation.

A refinement of the invention provides that as parameters a speed of the motor vehicle, a longitudinal acceleration of the motor vehicle, a transverse acceleration of the motor vehicle, a requested torque requested by the driver of the motor vehicle and/or by the driver assist system, a requested torque change, a steering angle, a change rate of the steering angle, a braking force, a requested braking force requested by the driver and/or the driver assist system, a number of braking procedures within a defined period of time, a currently set gear, an incline of the ground underneath the motor vehicle, an elevation of the motor vehicle above sea level, a driving resistance of the motor vehicle or a signaling state, in particular a blinker signaling state is used. In principle, any desired parameter can thus be selected if it relates to the combustion engine, the motor vehicle and/or the environment of the motor vehicle. The parameter can be any single one of the above-listed variables or any combination of thereof. As an alternative or in addition to the listed variables of course further variables, in particular state variables of the motor vehicle and/or the environment, can be used.

The speed of the motor vehicle can be the actual speed of the motor vehicle or alternatively a speed, which is determined from the rotational speed of the combustion engine and the selected transmission ratio. Corresponding considerations apply to the acceleration, which here means a longitudinal acceleration, i.e., an acceleration of the motor vehicle in longitudinal direction. The transverse acceleration is an acceleration in a direction, which is parallel to the ground underneath the motor vehicle and perpendicular to its longitudinal direction. The driving resistance describes preferably the sum of the forces which the motor vehicle has to overcome in order to maintain or accelerate to a desired speed. The driving resistance has a decelerating effect, i.e., is directed toward a deceleration of the motor vehicle. For example the driving resistance includes a rolling resistance of the motor vehicle, an air resistance, which depends on the speed, an incline resistance, which is dependent on the incline, and an acceleration resistance, which in particular takes the mass of the motor vehicle into account during a longitudinal acceleration.

The requested torque is the torque, which is requested by the driver of the motor vehicle or by the driver assist system. From the requested torque the target torque is determined which eventually is set at the combustion engine. In a simple embodiment, the target torque can be set to be equal to the requested torque. However, it can also be provided that the target torque is determined by an algorithm, in particular by a filtering from the required torque. The driver requests the requested torque in particular via a gas pedal position. In an advantageous embodiment the target torque is to be determined from the requested torque requested by the driver assist device and also used as parameter for determining the switching variable, when the driver assist device, for example a EPS driver assist device or the like, requests a torque which deviates from the one requested by the driver.

The requested torque change rate corresponds to the derivation of the requested torque over time at the current time point. Corresponding considerations apply to the steering angle change rate, which corresponds to the derivation of the steering angle over the time. The steering angle is hereby the steering angle, which is set at the steering device. The steering angle can be set in correspondence with a requested steering angle, which is for example set by the driver by means of a steering wheel. The braking force is the current braking force, i.e. an actual braking force, while a target braking force, which is set at the braking device is determined from the requested braking force. The requested braking force is for example requested by the driver or the driver assist device. The parameter can further correspond to the number of braking processes within a defined period of time. For this purpose for example the number of times the braking force and/or the requested braking force exceeds a threshold braking force within the defined period of time is counted. The defined period of time is in particular a period of time in the immediate past and ends at the current time point.

As an alternative the currently set gear can also be used as parameter, wherein the gear is set at a transmission of the motor vehicle via which the combustion engine is operatively connected with the wheels of the motor vehicle. Further parameters are the incline of the ground underneath the motor vehicle, which for example indicates a slope or downward slope, the elevation of the motor vehicle (for example above sea level), wherein also other reference elevations can be used, or the driving resistance of the motor vehicle, which includes in particular the rolling resistance. The latter is usually calculated or estimated by means of a model. Finally the signaling state can be used as a parameter. The signaling state is the state of for example a light signal of the motor vehicle, such as in particular the blinker. The signaling state can thus be given in the form of the blinker state.

A refinement of the invention provides that the switching variable is set exclusively after expiration of at least one waiting period determined from one of the parameters and/or when at least one recommended variable determined from the at least one parameter exceeds a threshold value. The switching variable is thus not directly but only indirectly dependent on the at least one parameter. Rather it is set by way of the at least one waiting period and/or the at least one recommended variable. The normally present value of the switching variable is 0. Only after expiration of the waiting period or when the recommended variable exceeds the threshold value, the switching variable is set to 1. Only in the latter case when in addition the condition is satisfied that the partial engine operation torque is greater or equal to the target torque, it can be switched from the full engine operation to the partial engine operation. The waiting period starts as soon as it is determined that the providable partial engine operation torque is greater or equal to the target torque. From this time point on a timer thus starts to run which is reset as soon as the partial engine operation torque becomes smaller than the target torque. Only when the timer has a value, which is greater than a waiting period the switching variable is set. The switching variable can already be set when only the waiting period is expired or the recommended variable exceeds the threshold value. Particularly preferably, the switching variable is however only set when both conditions are satisfied.

A refinement of the invention provides that at least one assessment module is provided in which the waiting period and/or the recommended variable are determined from the at least one parameter. The here provided method for operating the combustion engine is configured modular and can consist of any number of assessment modules. The assessment module has at least one of the aforementioned parameters as at least one input value. As at least one output value the assessment module outputs at least a waiting period, at least one recommended value or both. When multiple assessment modules are provided these operate independent of each other. In this way an easy expansion of the method by further assessment modules is possible.

In at least one embodiment of the invention it is provided that when by the steering angle exceeds a threshold steering angle, which is in particular determined in dependence in the speed and/or the longitudinal acceleration, the waiting period is set to a first waiting period value. The threshold steering angle can be selected constant or variable. In the latter case it is preferably determined as a function, which has the speed and/or the longitudinal acceleration as input values. When the currently set steering angle exceeded the threshold angle, the waiting period is set to the first waiting period value. In this way for example a typical roundabout traffic situation can be excluded, in this case switching from the full engine operation in into the partial engine operation does not occur because it can be assumed that when driving out of the roundabout traffic (or a similar situation) the motor vehicle is to be accelerated so that subsequently an immediate change from the partial engine operation to the full engine operation would be required.

In addition or as an alternative it is provided that when the braking force and/or the required baking force exceeds a threshold braking force the waiting period is set to a second waiting period value. The threshold braking force is preferably constant, i.e., it is not determined anew with each determining of the switching variable. However, an adjustment of the threshold braking force can also be carried out which is decoupled from the determining of the switching variable or the waiting period. The threshold braking force is for exampled defined in such a manner that it corresponds to an intermediately strong braking of the motor vehicle. As an alternative the threshold braking force can for example be determined in dependence on the speed of the motor vehicle. In particular the threshold braking force is the smaller the higher the speed of the motor vehicle is. The waiting period is then set to the second waiting period value when the currently actually present braking force or the requested braking force exceeds the threshold braking force.

It can also be provided that when the ground inclination exceeds a maximal threshold ground inclination, the waiting period is set to a third waiting period value. In case of a strong incline of the ground in particular the switching from the full engine operation into the partial engine operation is delayed by the third waiting period value. When the motor vehicle is located on such a slope, it is likely that a high torque has to be provided by the combustion engine for a short period of time insofar as the requested torque is also increased. Although the current requested torque is momentarily met by the partial engine operation torque, a high likelihood thus exists that this is only the case for a limited period of time and therefore the partial engine operation is to be abandoned quickly again.

It can also be provided that when the ground incline falls below a minimal threshold ground incline the waiting period is set to a fourth waiting period value. In this case a downward slope is present. This makes it likely that the motor vehicle has to be braked, for which the combustion engine is operated in a trailing throttle fuel cutoff mode. This however usually results in the switching from the partial engine operation into the full engine operation in order to increase the braking force of the combustion engine. Correspondingly the switching from the full engine operation into the partial engine operation is to be prevented via a waiting period, which corresponds to the fourth waiting period value.

An advantageous embodiment of the invention provides that the maximal threshold ground incline and/or the minimal threshold ground incline are determined in dependence on the elevation. The explanations above are in particular relevant when the motor vehicle is located at a high elevation for example during a drive over a pass or mountains. The greater the elevation the smaller is the specific power output of the combustion engine in particular when the combustion engine is operated in the suction operation. It is thus likely that the partial engine operation torque that can be provided is not sufficient to meet the target torque. Correspondingly the maximal threshold ground incline or the minimal threshold ground incline is to be determined as a function of the elevation of the motor vehicle. In addition it is noted that the maximal threshold ground incline is always to be greater than the minimal threshold ground incline, wherein the maximal threshold ground incline is typically greater than zero and the minimal threshold ground incline less than zero when the incline of a horizontal ground is defined as zero (for example 0°).

It can also be provided that when the requested torque change rate exceeds a maximal threshold requested torque change rate the waiting period is set to a fifth waiting period value when the requested torque is requested by the driver. When the driver requests the requested torque for example by means of a gas pedal, a linear continued movement of the vehicle can—when considering a defined time period—be assumed in good approximation. Positive changes pose the risk of exceeding the maximal providable torque in the partial engine operation, i.e., the partial engine operation torque. Correspondingly the change from the partial engine operation into the full engine operation is delayed by a waiting period, which corresponds to the fifth waiting period value.

In addition or as an alternative it can be provided that when the requested torque change rate falls below a minimal threshold requested torque change rate the waiting period is set to a sixth waiting period value, when the requested torque is requested by the driver.

Corresponding to the discussion above the expected requested torque can be linearly approximated when considering it in the defined time period. When the requested torque is decreased i.e., a negative requested torque change rate there is a high likelihood that the combustion engine is operated in the trailing throttle fuel cutoff mode. However, when this is the case, operating the combustion engine in the partial engine operation is not useful so that the waiting period is set to the sixth waiting period value. The latter is only the case however when the requested torque is requested by the driver but not when it is requested by the driver assist device. The last mentioned case is discussed in the following.

Similar considerations apply to the predetermining of the requested torque by the driver assist device. For example it is provided that when the requested torque change rate exceeds the maximal threshold requested torque change rate the waiting period is set to a seventh waiting period value when the requested torque is requested by the driver assist device. In addition or as an alternative it can be provided that when the requested torque change rate falls below the minimal threshold requested torque change rate the waiting period is set to an eight waiting period value when the requested torque is requested by the driver assist device.

In an advantageous embodiment of the invention it is provided that when the requested torque exceeds the partial engine operation torque the waiting period is set to a ninth waiting period value. Frequent movements of the gas pedal, in particular when considering a defined period of time, and a corresponding frequent change of the requested torque indicate a dynamic driving manner of the driver. Therefore it is provided that the threshold for triggering the delay corresponding to the ninth waiting period value is coupled to the partial engine operation torque, which can maximally provided by the combustion engine in the partial engine operation. Thus for example in gears with low transmission ratio and correspondingly rather small requested torques, the partial engine operation can still be authorized in spite of a dynamic driving by the driver and still the activation of the partial engine operation for too short a time be prevented. In this embodiment it is particularly advantageous when the requested torque is averaged, i.e., a requested torque mean value is compared with the partial engine operation torque. The mean value is formed from the requested torque present at defined time points in the defined time period in the past.

Finally it can be provided that the respective waiting period value is constant or is determined from the difference of the parameter and the corresponding threshold value. The aforementioned first to ninth waiting period value can thus be predetermined as constant. However, preferably this merely means that the respective waiting period value is not always determined anew with each determining of the switching variable or the waiting period. Rather an adjustment of the waiting period value can also occur in this case, however decoupled from the determining of the switching variable or the waiting period. Of course it can also be provided that the waiting period value is selected permanently constant. As an alternative the respective waiting period value can also be determined as a function of the parameter and the corresponding threshold value, for example from their difference. In case of a greater deviation of the parameter from the corresponding threshold value, a greater waiting period value is selected and in case of a smaller difference a smaller waiting period value is selected. With this a permanent adjustment to the current driving parameters of the motor vehicle is possible.

Besides the at least one waiting period in addition or alternatively the at least one recommended variable can be provided. The recommended variable is usually a value between −1 and +1 (including these values), which indicates whether changing to the partial engine operation is advantageous. Herby a recommended value of "−1" means a negative evaluation, "0" a neutral evaluation and "+1" a positive evaluation. When multiple recommended variables are provided, an overall recommended variable can be formed therefrom which is subsequently compared with the threshold value. The overall recommended variable can for example be a mean value of the multiple recommended variables or can be formed by normalizing. In the latter case the recommended variables, in particular by assigning a respective weighting factor to each recommended value, are added up for forming the overall recommended variable and divided by the number of the recommended variables or the sum of the weighting factors to form the overall recommended variable.

In a preferred embodiment of the invention it is provided that a statistical steering angle variable is determined from the steering angle, in particular the steering angle is averaged over a defined period of time to a steering angle mean value, and the recommended variable is determined from a further threshold steering angle which is determined in particular in dependence on the speed and/or the longitudinal acceleration, and the steering angle value or the steering angle mean value. It is thus provided to determine a statistical variable of the steering angle—the steering angle value. The steering angle value can for example be present as variance of the steering angle, as variance-type function of the steering angle or as mean value of the steering angle. In the latter case the steering angle is determined at defined time points within the defined time period and from these the steering angle mean value is calculated. The defined period of time is a period of time, which lies in the immediate past and which extends over a short time period during the drive of the motor vehicle. Subsequently, the steering angle variable is compared with the further threshold angle and by way of this comparison the recommended variable is determined. The recommended variable is insofar the starting value of a function, which has the steering angle variable and the further steering angle as input variables. Frequent steering movements in the recent past, i.e., within the defined time period, indicate city traffic and/or stop and go driving. These however lead to a frequent change between full engine operation and partial engine operation. Correspondingly under such conditions the switching from full engine operation to partial engine operation is to be prevented. For example when the steering angle variable exceeds the further threshold steering angle, the recommended variable is set to a first recommended value.

It can also be provided that the recommended variable is determined from a threshold number, which is in particular determined in dependence on the speed and/or the longitudinal acceleration, and the number of braking procedures. The number of the braking procedures was explained above.

The threshold number is for example set constant or as an alternative is determined from a function which has the speed or the longitudinal acceleration as input variable. For example it can be provided that when the number of the braking processes exceeds the threshold number the recommended variable is set to a second recommended value. Frequent braking pedal actuations, i.e., a high number of braking procedures in the immediate past like the frequent steering movements also indicate city traffic or stop and go driving. Correspondingly the changing to the partial engine operation is to be prevented.

In addition or as alternative it is provided that an acceleration reserve is determined from one or multiple parameters, a minimum acceleration reserve is determined and the recommended variable is determined from the acceleration reserve and the minimum acceleration reserve. The acceleration reserve is for example calculated from a calculated or estimated vehicle mass, the driving resistance and the ground incline, the partial engine operation torque and the currently engaged gear or the current transmission ratio. The acceleration reserve corresponds to the maximal longitudinal acceleration of the motor vehicle that can be achieved by the partial engine operation torque based on the current operating conditions or environmental conditions. In particular the maximum traction force that can be achieved with the partial engine operation torque and the current driving resistance are determined from the aforementioned variables. The difference between the traction force and the driving resistance is proportional to the maximum longitudinal acceleration still providable, i.e., the acceleration reserve. In addition the minimum acceleration reserve is determined, wherein the latter can for example be defined constant or variable. In the latter case the minimum acceleration reserve is for example determined from one of the parameters, wherein it is in particular dependent on the speed of the motor vehicle. The acceleration reserve is to correspond at least to the minimum acceleration reserve in order to authorize a switching into the partial engine operation. Therefore when the minimum acceleration reserve exceeds the acceleration reserve the recommended variable is set to a third recommended value that is, in particular, negative. In this way frequent short and, in particular, high-load fuel-intensive switchings between the full engine operation and the partial engine operation and vice versa can be prevented.

In addition or as an alternative it is provided that the longitudinal acceleration is averaged over a defined period of time to form an acceleration mean value, the acceleration reserve is determined from one or multiple of the parameters and the recommended variable is determined from the acceleration reserve and the acceleration mean value. Thus the acceleration mean value is to be formed from the longitudinal acceleration in the manner described above. In particular the defined period of time is an immediately preceding period of time, which extends over a short constant time period for example 0.1 s to 0.5 s. The acceleration mean value reflects the longitudinal acceleration requested in the past, in particular by the driver of the motor vehicle. The acceleration mean value is subsequently compared with the acceleration reserve. The acceleration reserve is calculated for example in the manner described above. It can be assumed that the future requested longitudinal acceleration and thus the target torque is to correspond at least to the longitudinal acceleration requested in the defined period of time. It is therefore in particular provided that when the acceleration mean value exceeds the acceleration reserve the recommended variable is set to a further recommended value. Instead of the acceleration mean value of course another appropriate statistical variable of the longitudinal acceleration, in particular the longitudinal acceleration present within the defined period of time, can be formed. Such a variable is for example the variance of the longitudinal acceleration or at least a variance type function, which can be determined with low computing effort.

It can also be provided that the recommended value is determined from the acceleration mean value and a threshold acceleration. Frequent changes of the speed in the immediate past indicate also city traffic or stop and go operation. Correspondingly the acceleration mean value is to be compared with the threshold acceleration. In particular it is provided that when the acceleration mean value exceeds the threshold acceleration the recommended variable is set to a fourth recommended value. The threshold acceleration can be selected constant or be adjusted from time to time.

In an advantageous embodiment it is provided that the recommended variable is determined from a trailing throttle fuel cutoff readiness of the combustion engine. The trailing throttle fuel cutoff readiness is for example determined by a control device of the combustion engine and means that a trailing throttle fuel cutoff mode is immediately impending, i.e., the combustion engine is operated in the trailing throttle fuel cutoff mode. When this is already known, the change from the full engine operation into the partial engine operation is to be prevented. This occurs for example in that the recommended variable is set to a fifth recommended value, which is negative. For example the fifth recommended value can be set to −1.

It can further be provided that navigation data of a navigation device of the motor vehicle are used to determine the waiting period and/or the recommended variable. In particular in this case the current position of the motor vehicle is also used. For example when it is determined that the motor vehicle while located on a route desired by the driver is to be involved in a situation which satisfies one of the aforementioned conditions, the waiting period or the recommended variable can be selected so that the switching from the partial engine operation into the full engine operation is prevented. This can for example be provided when the navigation data in combination with the current position of the motor vehicle indicate that the motor vehicle is about to driver over a ground with a ground incline which exceeds the maximal threshold ground incline or falls below the minimal threshold ground incline. Similarly, for example traffic density data can be used in order to determine whether the motor vehicle will soon encounter city traffic or stop and go traffic. These possibilities however are to be understood as merely exemplary. The determining of the waiting period or the recommended variable from the navigation data can be provided in connection with using all aforementioned conditions.

Finally it can be provided that the transverse acceleration and/or an appropriate statistical variable formed from the transverse acceleration, in particular the variance of the transverse acceleration, is used for determining the waiting period and/or the recommended variable. A high transverse acceleration indicates a curve driving of the motor vehicle. Corresponding to the description above with regard to the steering angle, switching between the full engine operation and the partial engine operation is to be prevented. For example a sufficiently long waiting period or an appropriate recommended variable is set when the transverse acceleration or the statistical variable exceeds a threshold transverse acceleration.

A refinement of the invention provides that for determining the switching variable a decision module is provided with which the waiting period and/or the recommended variable is provided by the at least one assessment module. The decision module thus receives the input variable, the at least one waiting period and/or the at least one recommended variable. Subsequently it tests in particular by means of a timer, whether the at least one waiting period has already expired. In addition or as an alternative it is tested whether the recommended variable or the overall recommended variable, which is formed from the multiple recommended variables, exceeds the threshold value. When this is the case the switching variable is set, i.e., provided with the value "1". Otherwise the switching variable is deleted and insofar set to "0". The thus determined switching variable is subsequently provided by the assessment module as output value, for example to a control device of the combustion engine.

A refinement of the invention provides that multiple waiting periods are provided and the switching variable is only set after all waiting periods have expired and/or when multiple recommended variables are present, the weightings are combined to an overall recommended variable and only when the overall recommended variable exceeds the threshold value the switching variable is set. A corresponding procedure was already discussed above. For example it can be provided that an overall waiting period is formed from the multiple waiting periods, in particular in that the overall waiting period is set equal to the greatest of the multiple waiting periods. With regard to the overall recommended variables it can be proved to define the overall recommended variable as mean value of the multiple recommended variables. As an alternative the overall recommended variable can for example be defined by normalizing as the sum of the multiple recommended variables. In this case the individual recommended variables are respectively evenly weighted. Preferably each of the recommended variables is assigned a weighting coefficient or weighting factor each of the recommended variables is multiplied With the weighting factor and the results of the multiplication are added up. The result of the addition in turn is divided by the sum of all weighting coefficients, whereby the weighted overall recommended variable is obtained.

It is noted that in the discussion above instead of a mean value of a variable another appropriate statistical variable, for example the variance of the variable, can be used. The waiting period is preferably reset in particular to zero if it is not set to the waiting period value. Analogously the recommended variable is to be set to a neutral value, in particular zero, or a positive value when it is not set to the recommended value.

It is particularly advantageous when the mentioned threshold values, waiting period values, recommended values, weighting coefficients and/or parameters fort the averaging are set individually for the particular driver. The mentioned values are thus stored for each driver in a nonvolatile memory and are provided for the method prior to the drive.

In addition it can be provided that the threshold values, waiting period values, recommended values, weighting coefficients and/or parameters for the averaging are adjusted to the respective driver during a drive of the motor vehicle. It is also provided that the here disclosed method is configured with learning capabilities in order to maximize the fuel saving achieved by the prevention of the switching between the full engine operation and the partial engine operation. In such a configuration the mentioned values are for example read out of the nonvolatile memory and provided to the method. During the drive the values are adjusted so that the fuel saving is maximized by optimizing the values. After the drive, in particular after turning the combustion engine off, the values are written back into the nonvolatile memory so as to be available at the subsequent drive.

A refinement of the invention provides that the parameter is filtered and/or smoothened prior to determining the switching variable, in particular prior to determining the waiting period and/or the recommended variable. In this way it can be prevented that jumps in the parameters adversely affect the determined switching variable. When multiple parameters are provided, at least one of the parameters is filtered or smoothened. However, preferably this applies to all of the used parameters.

A refinement of the invention provides for switching from the partial engine operation to the full engine operation already when the partial engine operation torque provided by the combustion engine in the partial engine operation is smaller that the target torque set at the combustion engine. Correspondingly, for the decision whether to change from the partial engine operation into the full engine operation it is irrelevant which value the switching variable has. The change solely depends on whether the partial engine operation torque covers the target torque or the requested torque. As soon as the target torque or the requested torque is greater than the partial engine operation torque it is changed from the partial engine operation to the full engine operation.

The invention also relates to a combustion engine of a motor vehicle with multiple cylinders, in particular for implementing the method according to the description above, wherein the combustion engine has means to operate all of the cylinders in a full engine operation and to partially turn them off in a partial engine operation, wherein it is provided to only change from the full engine operation into the partial engine operation when a torque which is providable by the combustion engine in the partial engine operation is greater or equal to a target torque set at the combustion engine. It is provided that for the change from the full engine operation into the partial engine operation in addition a switching variable has to be set, which is determined from at least one defined parameter of the combustion engine and/or the motor vehicle. The combustion engine serves insofar advantageously for implementing the described method. The method can be refined according to the description above. The combustion engine is configured for performing the cylinder switch-off and for this purpose has the means to either operate all of the cylinders in the full engine operation or to partially turn them off in the partial engine operation. However, compared to known combustion engines, which are also configured for performing a cylinder switch-off, the here disclosed combustion engine has the advantage that the fuel consumption is further reduced in that the efficiency of the combustion engine is increased. This is accomplished in that the switching from the full engine operation into the partial engine operation is prevented when the operating conditions are not expected to allow the advantageous performing of the partial engine operation over the amortization time.

The invention is explained in more detail by way of exemplary embodiments shown in the drawing without limiting the in invention. It is shown in:

DETAILED DESCRIPTION OF PREFERRED EMBODIMENTS

Figure 1:
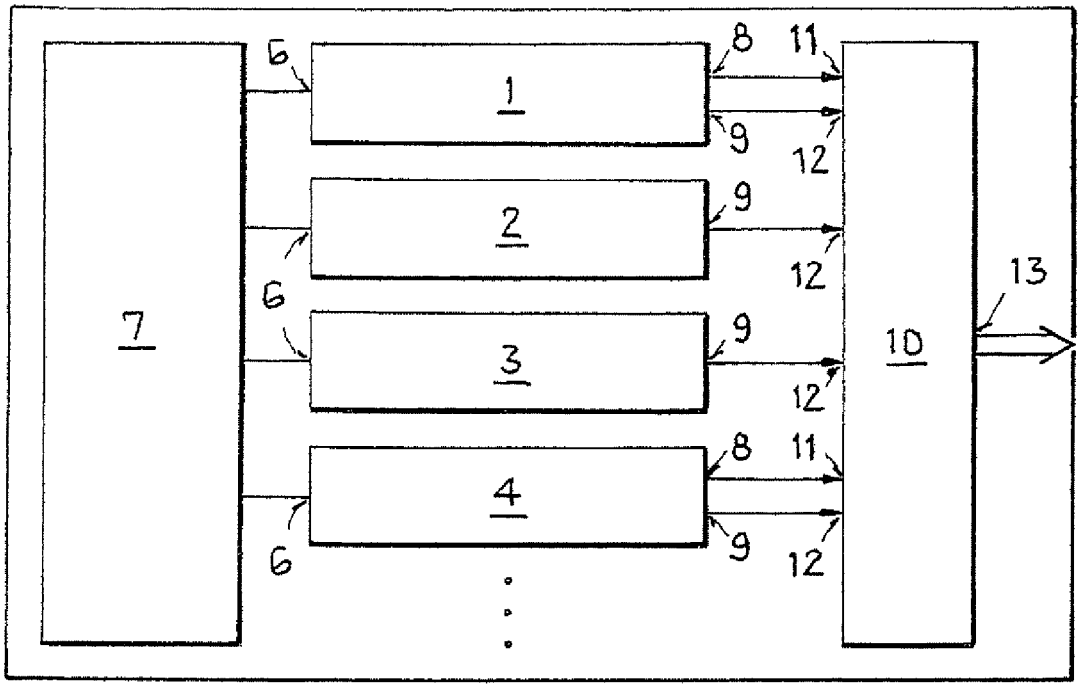
FIG. 1 a schematic representation of a method for operating a combustion engine of a motor vehicle with multiple cylinders which is configured for operating a full engine operation and a partial engine operation, FIG. 2 a diagram in which the functioning of the method according to the invention is illustrated, and FIG. 3 a diagram in which the number of the changes from the full engine operation into the partial engine operation is blotted over the duration of the partial engine operation.

FIG. 1 shows a schematic representation of a method for operating a combustion engine of a motor vehicle. The combustion engine has multiple cylinders, the entirety of which is operated in a full engine operation. On the other hand, when the combustion engine is used in partial engine operation at least one of the cylinders is turned off. In the partial engine operation the torque, which can be provided by the combustion engine, is thus reduced in the partial engine operation compared to a maximal torque of the combustion engine. The torque, which can be provided in the partial engine operation is referred to as partial engine operation torque. The method according to the invention for operating the combustion engine has an assessment module 1 to 4 which in each case has at least one input 6, at which at least one parameter (block 7) as input variable is provided to the assessment modules 1 to 4.

The parameter is for example a speed of the motor vehicle, a (longitudinal) acceleration of the motor vehicle, a transverse acceleration of the motor vehicle, a requested torque requested by the driver of the motor vehicle and/or by a driver assist device, a requested torque change rate, a steering angle, a steering angle change rate, a braking force, a requested braking force requested by the driver and/or the driver assist device, a number of braking procedures within a defined time period, a currently set gear, a ground incline of a ground underneath the motor vehicle, an elevation of the motor vehicle, a driving resistance of the motor vehicle or a signaling state, in particular a blinker state. The at least one parameter is provided to each of the assessment modules 1 to 4. Each of the assessment modules 1 to 4 has at least one output 8 and/or one output 9. At the output 8 a respective waiting period is provided as output variable and at the output 9 a recommended variable is provided as output variable. The output variable serves in turn as input variable for a decision module 10, which has corresponding inputs 11 and 12. The decision module 10 determines from the waiting periods and recommended variables which lie on the inputs 11 and 12, a switching variable which is subsequently provided at an output 13 of the decision module 10 as output variable. The waiting periods are preferably given as seconds while the recommended variables are dimension-less normalized values between −1 and 1 or 0 and 1, wherein the smaller value means that the partial engine operation should not be initiated. The greater value on the other hand stands for a positive assessment.

The assessment module 1 is for example a "city recognition" and/or "stop and go" assessment module. In this case in particular the steering angle, the braking force of a steering angle averaged over a defined period of time and the number of braking procedures in the defined period of time are used as input variables. When the steering angle exceeds a defined threshold angle the waiting period $V_1$ is set to a first waiting period value $V_{V1}$. When the braking force exceeds a defined threshold braking force the waiting period $V_2$ is set to second waiting period value $V_{V2}$. At the same time the steering angle is to be averaged over a defined period of time to a mean steering angle value. When this steering angle mean value exceeds a threshold steering angle, which is determined in dependence on the speed, a recommended variable $E_1$ is set to a first recommended value $E_{V1}$. It is also determined whether the number of braking procedures within the defined period of time exceeds a threshold number, which for example is also defined in dependence on the speed of the motor vehicle. When this is the case a recommended variable $E_2$ is set to a second recommended value $E_{V2}$.

The assessment module 2 can be referred to as "acceleration reserve" assessment module. When the ground incline of the ground underneath the motor vehicle exceeds a maximal threshold ground incline, the waiting period $V_3$ is set to a third waiting period value $V_{V3}$. Similarly, when the ground incline falls below a minimal threshold ground incline, a waiting period $V_4$ is set to a fourth waiting period value $V_{V4}$. Hereby it is particularly provided that the maximal threshold ground incline and/or the minimal threshold ground incline are determined in dependence on the elevation of the motor vehicle. In parallel thereto an acceleration reserve is determined in the assessment module 2, in which in particular a calculated or estimated vehicle mass and the driving resistance, the ground incline, the partial engine operation torque and the currently engaged gear or the current transmission ratio corresponding to the currently engaged gear are included. The acceleration reserve corresponds to the longitudinal acceleration, which the motor vehicle can maximally achieve by means of the partial engine operation torque. At the same time a minimal acceleration reserve is determined which is also to be able to be achieved after the switching into the partial engine operation. The minimal acceleration reserve is for example constant or is determined variable in an appropriate manner. When the minimal acceleration reserve is greater than the acceleration reserve, a recommended variable $E_3$ is set to a third recommended value $E_{V3}$. Of course it can also be provided to set the recommended variable $E_3$ when the acceleration reserve is greater than the minimal acceleration reserve. As an alternative or in addition the longitudinal acceleration is averaged over the defined period of time in the immediate past to the acceleration mean value. When the acceleration exceeds the acceleration reserve the recommended variable $E_{3'}$ is set to a recommended value $E_{V3'}$.

The assessment module 3 relates to a change of the vehicle speed and is insofar referred to as "vehicle speed change" assessment module. The acceleration mean value described above is compared with a threshold acceleration. When the acceleration mean value exceeds the threshold acceleration a recommended variable $E_4$ is set to a fourth recommended value $E_{V4}$.

Finally, the assessment module 4 represents a "dynamic recognition" assessment module. The latter observes in particular the requested torque change rate, wherein it is distinguished between whether the requested torque is requested by the driver of the motor vehicle or by the driver assist device. In the former case a waiting period $V_5$ is set to a fifth waiting period value $V_{V5}$ when the requested torque change rate exceeds a maximal threshold requested torque change rate. In addition or as alternative, a waiting period $V_6$ is set to a sixth waiting period value $V_{V6}$ when the requested torque change rate falls below a maximal threshold requested torque change rate. On the other hand, when the requested torque is requested by the driver assist device, a waiting period $V_7$ is to be set to a seventh waiting period value $V_{V7}$ when the requested torque change rate exceeds the maximal threshold requested torque change rate and/or a waiting period value $V_8$ is set to an eight waiting period value $V_{V8}$ when the requested torque change rate falls below the maximal threshold requested torque change rate. At the same time it can be provided that it is tested whether a trailing throttle fuel cutoff readiness of the combustion engine is present. When this is the case a recommended value $E_5$ is set to a fifth recommended value $E_{V5}$, which in particular is negative. It can also be provided that when a requested torque requested by the driver or the driver assist device exceeds the partial engine operation torque, a waiting period $V_9$ is set to a ninth waiting period value $V_{V9}$.

In the decision module it is now tested whether all waiting periods $V_1$ to $V_9$ are already expired. At the same time an overall recommended variable E is calculated from all recommended variables $E_1$ to $E_5$ preferably by using speed coefficients for the individual recommended variables $E_1$ to $E_5$. When all waiting periods are expired and when the overall recommended variable exceeds a defined threshold value, the switching variable is set. Otherwise the switching variable is reset. It is provided that switching from the full engine operation into the partial engine operation is only permitted if the partial engine operation torque which can be provided in the partial engine operation is greater or equal to the target torque set at the combustion engine and the switching variable is set.

In general, all waiting period values $V_{Vx}$ (with x=1 . . . 9) are preferably greater than 0. The recommended values $E_{Vx}$ (with x=1 . . . 5) are preferably smaller than 1. When these conditions are not met the corresponding waiting period $V_x$ (with x=1 . . . 9) is set to zero. In analogy thereto the recommended variables Ex (with x=1 . . . 5) are to be set to the value, which corresponds to a recommendation to change into the partial engine operation and is thus usually 1 or neutral. When the conditions are met, initiation of the partial engine operation is either immediately delayed or a recommendation against the initiation is issued by the recommended variables $E_x$ and thus depending on the circumstances an indirect delay is caused. When the overall recommended value E, which is determined from the recommended variables, reaches the threshold value, the change (when all other conditions are met) is permitted. Otherwise it is prevented.

Of course it can be provided that the waiting period values $V_{Vx}$ and/or the recommended values $E_{Vx}$ are constant. In this case they are selected so that during average operation of the combustion engine the fuel savings accomplished by the partial engine operation are maximal. Particularly the mentioned values or at least one of the values are however preferably selected as variable and are individually adjusted to the driver of the motor vehicle. For this purpose, an optimizing operation or learning operation is carried out during the drive of the motor vehicle, during which the values are varied so that fuel saving is increased. Analogously such an approach can of course also be applied in addition to or as alternative to the threshold values, weighting coefficients and/or the parameters for the method or, rather, for the forming of the mean or average values described above. Such a parameter is for example the defined period of time, the number of time points that are observed within the period of time or the like.

Figure 2:
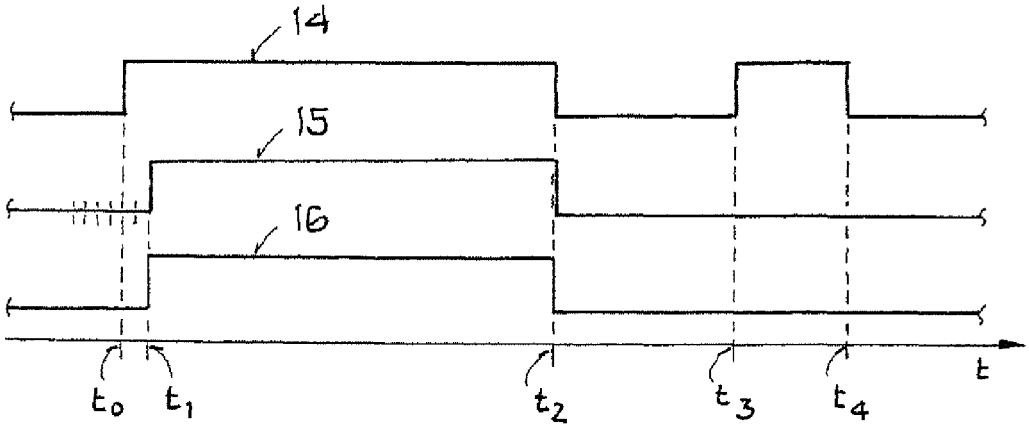

FIG. 2 is a diagram illustrating the functioning of the method. The courses 14 and 15 and 16, which can only assume two states, i.e., "0" and "1", are shown over time. The course 14 indicates during operation of the combustion engine whether the partial engine operation torque is greater or equal to the target torque. This is the case between the time points $t_0$ and $t_2$ as well as $t_3$ and $t_4$. The course 15 shows the state of the switching variable. It becomes clear that the switching variable is only set in the time period between $t_1$ and $t_2$. The course 16 indicates whether the combustion engine is operated in the partial engine operation, i.e., whether a cylinder turn-off is carried out. This can only be the case when the switching variable is set, i.e., has a value of "1". Correspondingly the partial engine operation is only carried out in the time period between $t_1$ and $t_2$. Solely based on the observation of the partial engine operation torque and the target torque the operation of the partial engine operation would also be possible in the time period between $t_3$ and $t_4$. This is already recognized by estimation by the method according to the invention at the beginning of the time period and the switching variable is not set. The turning off of the cylinders, i.e., the operation of the combustion engine in the partial engine operation over the short period of time between $t_3$ and $t_4$ is thus prevented.

Figure 3:
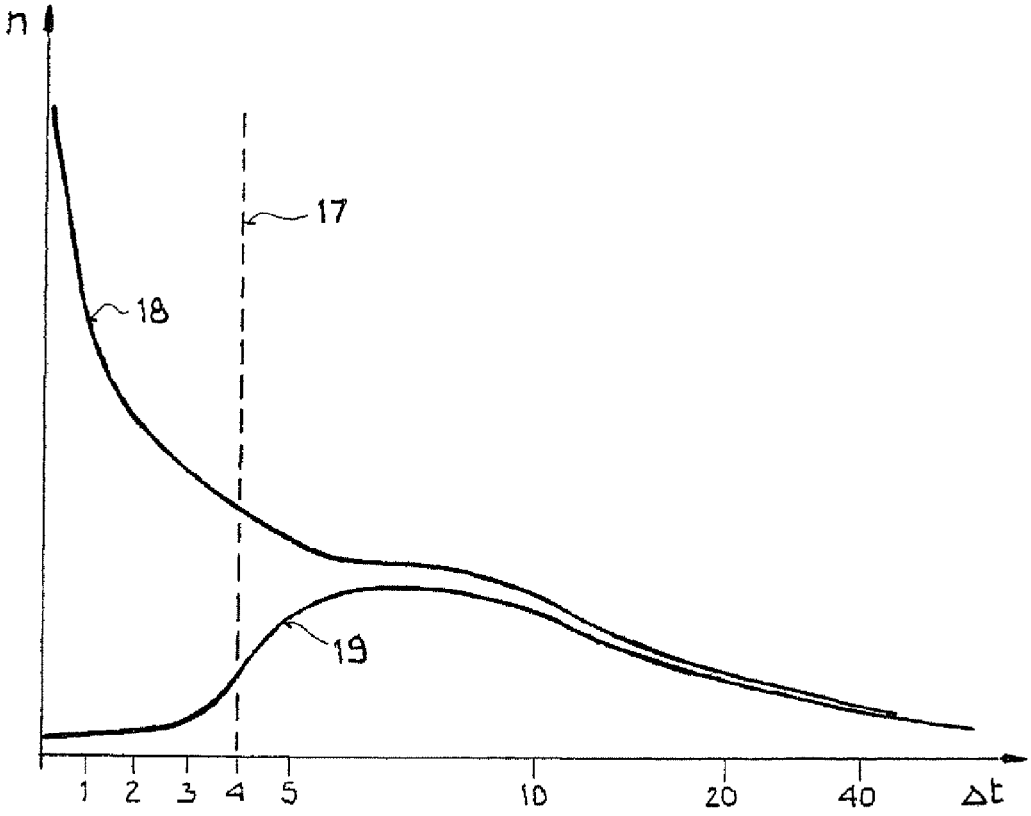

FIG. 3 shows a diagram in which the number n of the events of switching from the full engine operation into the partial engine operation is blotted over the duration Δt of the partial engine operation. An amortization time is exemplary indicated at Δt=4 s by the line 17. Usually, the amortization time Δt is however not constant but rather depends on an operating condition or load point of the combustion engine. For time periods Δt shorter than the amortization time, i.e., on the left hand side of line 17, the switching from the full engine operation into the partial engine operation is not useful because no fuel saving can be achieved. On the other hand, on the right hand side of the line 17, i.e., at time periods Δt, which are longer than the amortization time, the performance of the partial engine operation is useful. A course 18 shows the frequency of the switching between the full engine operation and the partial engine operation in a conventional method for operating the combustion engine in which it is only observed whether the partial motor torque is greater or equal to the target torque. It becomes clear that very often an only short time partial engine operation is performed. On the other hand when the method described above is used a course 19 can be achieved in which the frequency of the partial engine operation with a duration of Δt which is smaller than the amortization time, is significantly reduced.

The invention claimed is:

1. A method for operating a combustion engine of a motor vehicle, said engine having multiple cylinders and a partial engine operation torque, said engine and said vehicle having defined parameters, a target torque set at the engine, and an engine controller having a switching variable, said controller being configured to selectively operate the engine in a full engine operation and in a partial engine operation, with all of the cylinders being operated in the full engine operation and at least one of the cylinders being deactivated in the partial engine operation, said method comprising:

determining an acceleration reserve as a function of at least one defined parameter;

defining a minimum acceleration reserve;

determining a recommended value as a function of the acceleration reserve and the minimum acceleration reserve;

setting the switching variable when the recommended value exceeds a threshold value; and switching from the full engine operation to the partial engine operation only when: a) a partial engine operation torque producible by the combustion engine in the partial engine operation is greater than or at least equal to a target torque set on the combustion engine and b) the switching variable is set.

2. The method of claim 1, wherein the setting of the switching variable is determined in defined time intervals during the operation of the combustion engine.

3. The method of claim 1, wherein the at least one defined parameter is selected from a group consisting of a speed of the motor vehicle, a longitudinal acceleration of the motor vehicle, a currently selected gear, an incline of the ground underneath the motor vehicle, an elevation of the motor vehicle above sea level and a driving resistance of the motor vehicle.

4. The method of claim 1, wherein the switching variable is exclusively set after the expiration of at least one waiting period determined as a function of at least one defined parameter.

5. The method of claim 4, wherein the at least one waiting period comprises multiple waiting periods and wherein the switching variable is only set after expiration of all the multiple waiting periods.

6. The method of claim 1, further comprising switching from the partial motor operation to the full motor operation when the partial engine operation torque providable by the combustion engine in the partial engine operation is smaller than the target torque set at the combustion engine.

7. A combustion engine of a motor vehicle, said engine having a partial engine operation torque and said vehicle having defined parameters and a target torque set at the engine, comprising:

multiple cylinders in the engine; and an engine controller, said controller having a switching variable, said controller being configured to selectively operate all of the multiple cylinders in a full engine operation and to switch at least one of the cylinders off so as operate in a partial engine operation, the controller being configured to:

determine an acceleration reserve from at least one defined parameter, define a minimum acceleration reserve, determine a recommended value as a function of the acceleration reserve and the minimum acceleration reserve, and switch from the full engine operation to the partial engine operation only when: a) a partial engine operation torque producible by the combustion engine in the partial engine operation is greater than or at least equal to a target torque set on the combustion engine, and b) the switching variable is set, said switching variable being set when the recommended value exceeds a threshold value.

8. The combustion engine of claim 7, further comprising multiple assessment modules that independently determine at least one waiting period and/or at least one recommended value as a function of at least one defined parameter.

9. The combustion engine claim 7, further comprising a decision module in communication with at least one assessment module, said decision module being configured to determine the setting of the switching variable using at least one recommended value and/or the value of at least one waiting period after a partial engine operation torque that is producible in the partial engine operation of the combustion engine becomes greater than or equal to a target torque set on the combustion engine, said at least one value being provided by at least one assessment module to the decision module.

10. The combustion engine of claim 7, wherein the setting of switching variable is determined by the decision module in defined time intervals during the operation of the combustion engine.

11. The combustion engine of claim 7, wherein the at least one defined parameter is selected from a group consisting of a speed of the motor vehicle, a longitudinal acceleration of the motor vehicle, a currently selected gear, an incline of the ground underneath the motor vehicle, an elevation of the motor vehicle above sea level and a driving resistance of the motor vehicle.

12. The combustion engine of claim 9, wherein the switching variable is exclusively set by the decision module after the expiration of at least one waiting period determined by at least one assessment module as a function of at least one defined parameter.

13. The combustion engine of claim 12, wherein a waiting period is a period of time waited after a partial engine operation torque that is producible in the partial engine operation of the combustion engine is greater than or equal to a target torque set on the combustion engine.

14. The combustion engine of claim 10, wherein multiple recommended values are provided to the decision module and the recommended value used by the decision module to determine the setting of the switching variable is a mean or weighted overall recommended value of the multiple recommended values.

15. The combustion engine of claim 12, wherein the at least one waiting period comprises multiple waiting periods and wherein the switching variable is only set by the decision module after expiration of all the multiple waiting periods.

16. The combustion engine of claim 7, wherein the controller switches the combustion engine from the partial motor operation to the full motor operation when the partial engine operation torque providable by the combustion engine in the partial engine operation is smaller than the target torque set at the combustion engine.

17. The combustion engine of claim 12, wherein the at least one waiting period comprises multiple waiting periods and wherein the switching variable is only set after expiration of the longest of the multiple waiting periods.

18. The method of claim 4, wherein a waiting period is a period of time waited after a partial engine operation torque that is producible in the partial engine operation of the combustion engine is greater than or equal to a target torque set on the combustion engine.

19. The method of claim 1, wherein multiple recommended values are determined and the recommended value used to determine the setting of the switching variable is a mean or weighted overall recommended value of the multiple recommended values.

20. The method of claim 1, wherein the recommended value is determined from a statistical steering angle variable determined at defined points in time that is a member of a group comprised of a variance of the steering angle, a variance-type function of the steering angle, or a mean value of the steering angle, that is determined over a period of time, that is compared to a steering angle threshold value.

21. The method of claim 1, wherein a recommended value is determined from the number of braking procedures occurring over a period of time, that is compared to a threshold number of braking procedures determined in dependence on the longitudinal speed or acceleration of the motor vehicle, so that the recommended value tends to prevent partial engine operation when frequent braking within a defined time period indicate a city-type driving condition.

22. The method of claim 1, wherein a recommended value is determined from a statistical longitudinal acceleration value determined at defined points in time over a period of time, that is a member of a group comprised of a variance of the acceleration, a variance-type function of the acceleration, or a mean value of the acceleration, compared to an acceleration threshold value that tends to prevent partial engine operation when frequent acceleration within a defined time period indicate a city-type driving condition.

23. The method of claim 1, wherein a recommended value is determined from a statistical transverse acceleration value determined at defined points in time over a period of time, that is a member of a group comprised of a variance of the transverse acceleration, a variance-type function of the transverse acceleration, or a mean value of the transverse acceleration, compared to a transverse acceleration threshold value that tends to prevent partial engine operation when the transverse acceleration within a defined time period indicates the vehicle is driving along a curved road.

24. The method of claim 1, wherein a recommended value is determined by the trailing throttle fuel cutoff readiness state of a control device of the combustion engine so that when the engine is in a trailing throttle fuel cutoff readiness state, the recommended value tends to prevent partial engine operation.

* * * * *